US005721411A

United States Patent [19]

Ervin

[11] Patent Number: 5,721,411

[45] Date of Patent: Feb. 24, 1998

[54] GARBAGE DISPOSAL SWITCH ASSEMBLY

[76] Inventor: John D. Ervin, 810 Bolboa Ln., Foster City, Calif. 94404

[21] Appl. No.: 605,392

[22] Filed: Feb. 22, 1996

[51] Int. Cl.[6] ..... H01H 35/26; B02C 23/00

[52] U.S. Cl. ..... 200/837; 200/81 H; 241/32.5

[58] Field of Search ..... 4/619, 629; 200/81 H, 200/81 R, 837, 61.6, 61.2, 61.21, 81.4; 241/32.5, 46.01, 46.02, 46.04, 46.08, 46.11, 46.13, 46.17, 46.012, 46.013–46.017

[56] References Cited

U.S. PATENT DOCUMENTS

| | | | |
|---|---|---|---|
| 3,034,734 | 5/1962 | Guth | 241/36 |
| 4,124,789 | 11/1978 | Preece | 200/81 R |
| 4,209,678 | 6/1980 | Hussey | 200/81 R |
| 4,399,832 | 8/1983 | Appleby | 137/216 |
| 4,910,808 | 3/1990 | Roth | 04/222 |
| 5,539,166 | 7/1996 | Reier | 200/81 R |

*Primary Examiner*—Cassandra C. Spyrou
*Assistant Examiner*—Michael A. Friedhofer

[57] ABSTRACT

A garbage disposal switch assembly having a unique dishwasher air gap body having a vertically oriented upper tubular portion, a first lower tubular portion and a second lower tubular portion. An air tube extends upwardly through, the upper tubular portion and is connected to the bottom end of a bellows mounted in a tubular sleeve supported on the upper tubular portion. The bottom end of the air tube is connected to an air switch positioned electrically in series between a garbage disposal and the source of electrical power for operating the garbage disposal. The air switch is mounted in an electrical box housing in the interior of a cabinet beneath the kitchen sink. An outer cap telescopes over the bellows and the upper tubular portion. The outer cap can be rotated to a selected position that allows it to be depressed thereby causing the bellows to be depressed which in turn actuates the air switch and results in the garbage disposal being operated. The dishwater air gap body is installed through the existing aperture in the top of the sink thereby allowing the garbage disposal to be conveniently turned on and off.

9 Claims, 2 Drawing Sheets

GARBAGE DISPOSAL SWITCH ASSEMBLY

BACKGROUND OF THE INVENTION invention relates to a kitchen appliance, namely a garbage disposal. More specifically, the invention relates to a garbage disposal switch that can be actuated by pressing downwardly on the body cap that covers the top end of the dishwasher air gap body that extends upwardly through an aperture in the top surface of the kitchen sink.

Historically, the switch for operating the garbage disposal has been mounted on a wall above the kitchen sink counter surface. In recent years, kitchens have been designed with large windows in the sink area which has created a problem for placing the garage disposal switch in a convenient location. The necessity of having to step away from the work, area of the sink to actuate the switch is inconvenient and nonproductive. Since it is necessary to run the water during the operation of the disposal, the user of the disposal unit frequently has wet hands and often receives an electrical shock. The creation by kitchen designers of island sinks in the middle of the kitchen has resulted in the same problem requiring walking several steps in order to turn the wall switch on and It is an object of the invention to provide a novel garbage disposal switch assembly that will change the way in which the garbage disposal is turned on and off.

It is another object of the invention to provide a novel garbage disposal switch assembly that can be actuated while standing at the sink since it is merely necessary to push down top of the outer cap that covers the top end of the dishwasher air gap body that extends upwardly through the top surface of the sink.

It is another of the invention to provide a novel garbage disposal switch assembly that eliminates the possibility of the person turning on the garbage disposal switch receiving an electrical shock.

It is an additional object of the invention to provide a novel garbage disposal switch assembly that is economical to manufacture and market.

It is a further object of the invention to provide a novel garbage disposal switch assembly that can be easily installed.

SUMMARY OF THE INVENTION

The novel garbage disposal switch assembly has been designed specifically with the consumer in mind. The structure of the switch assembly that turns the garbage disposal on and off is conveniently installed adjacent to the faucet of the sink, thus eliminating the need for the user to reach for, or open a cabinet door to flip on the traditional electric disposal switch. The garbage disposal switch assembly ingeniously combines a fully air activated switch with the dishwasher air gap therefore precluding the need for an additional hole in the sink top. Remodeling contractors and advocates of an uncluttered counter will appreciate this feature.

Safety was one of the primary considerations when designing the novel garbage disposal switch assembly. Because it is pneumatically activated, there is no electric current at the outer cap that covers the top end of the dishwasher air gap body. The easy press on . . . press off . . . motion on the outer cap sends a pulse of air to an air switch located within the sink cabinet. The outer cap has been designed to only allow itself to be pressed downwardly when oriented in a predetermined position. Rotation of the outer cap in either direction from this position prevents its accidental activation. The garbage disposal switch assembly is easily installed and it is suitable for any sink configured for a dishwasher air gap.

The dishwasher air gap body has an air tube passing upwardly through its upper tubular portion. The top end of the air tube is connected to a bellows having an air chamber therein. The pressing downwardly on the outer cap compresses the bellows downwardly forcing the air therein down the air tube whose bottom end is connected to an on/off air switch. The air switch is mounted in an electrical box housing that also contains a primary electrical outlet socket into which is inserted the plug from the garbage disposal. An electrical cord extends from the electrical box housing and the male connector on its end is inserted into the existing electrical outlet positioned in the cabinet beneath the sink.

DESCRIPTION OF THE PREFERRED EMBODIMENT

Figure 1:
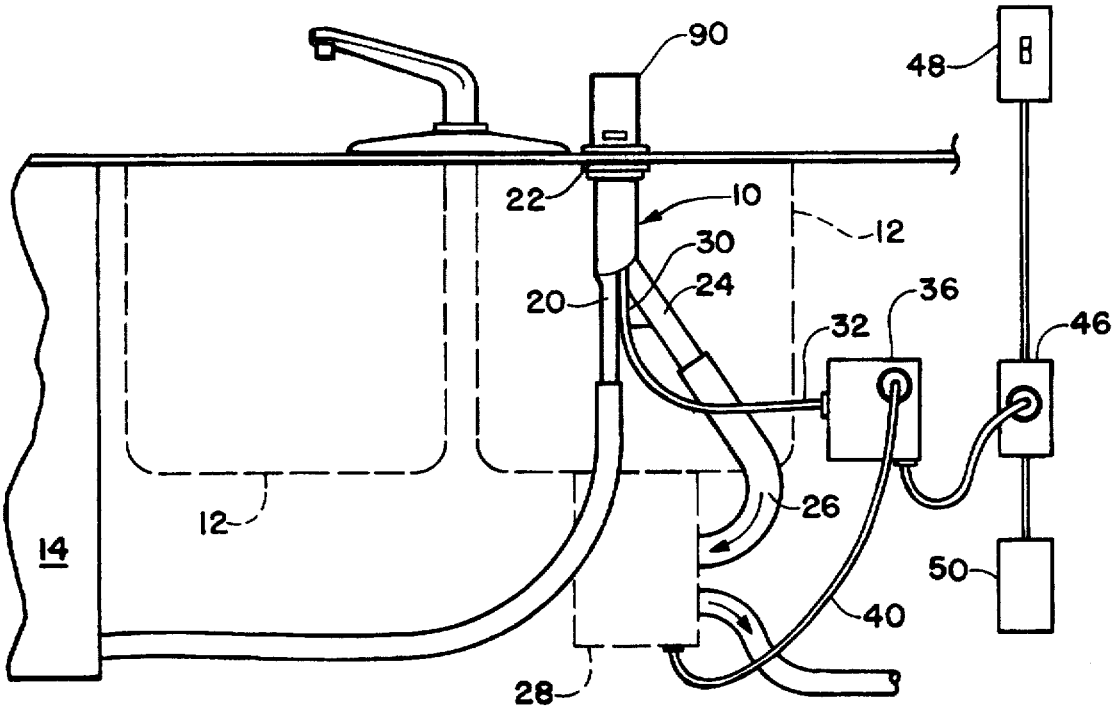
FIG. 1 is a schematic illustration showing the manner in which the novel garbage disposal switch assembly is connected to a dishwasher and garbage disposal.

The novel garbage disposal switch assembly will now be described by referring to FIGS. 1–4 of the drawings. FIG. 1 is a schematic diagram showing a dishwasher air gap body 10 mounted in an existing aperture in the top surface of kitchen sink 12. Dishwasher 14 is mounted below counter 16 and it is connected by a hose 18 to lower tubular portion 20 of dishwasher air gap body 10. A locknut 22 is tightened upwardly to hold the dishwasher airgap body securely in position.

Lower tubular portion 24 is connected by hose 26 to garbage disposal 28. An air tube 30 protrudes from the bottom end of dishwasher air gap body 10 and it is connected to flexible tubing 32 that is connected to an on/off air switch 34. Air switch 34 is mounted in electrical box housing 36 along with primary electrical outlet socket 38. Electrical cord 40 extending from garbage disposal 28 is plugged into primary electrical outlet socket 38. An electrical cord 42 extends from electrical box housing 36 and its male connector member 44 is plugged into electrical socket 46 that is normally found beneath the sink and inside the cabinet. Wall switch 48 is connected to electrical socket 46 as is a source of a.c. power 50.

Figure 3:
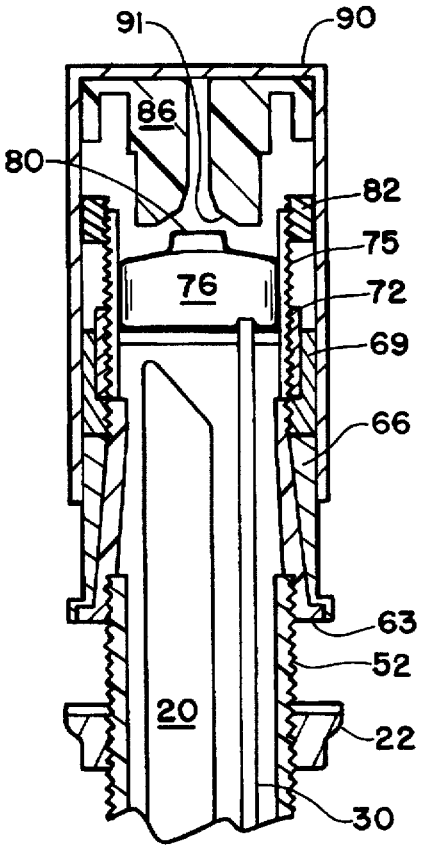
FIG. 3 is a vertical cross sectional view of the dishwasher air gap body and its associated structural components.
Figure 2:
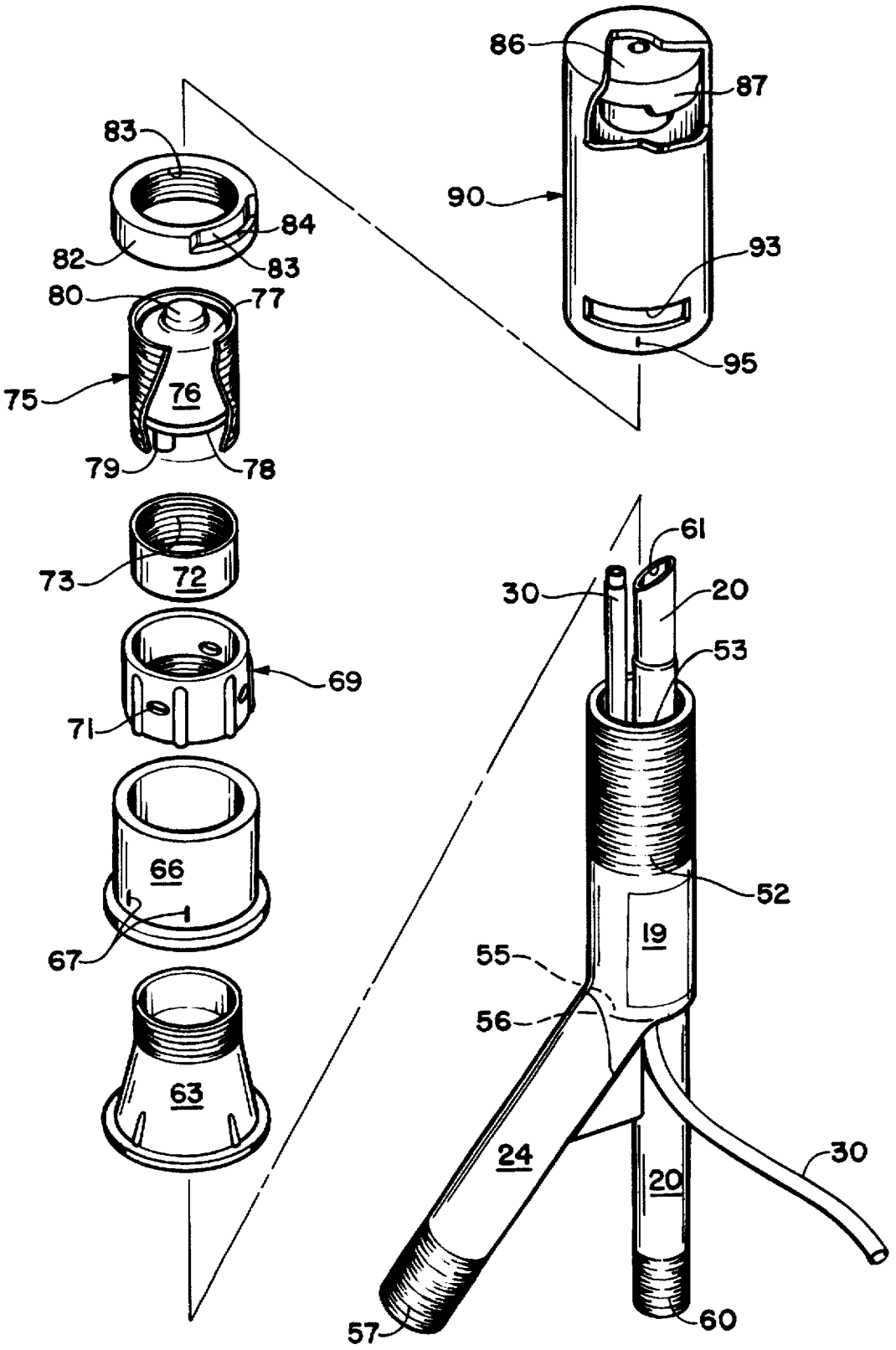
FIG. 2 is an exploded perspective view of the dishwasher air gap body and associated components.

The specific structure of the dishwasher air gap body 10 is illustrated in FIGS. 2 and 3. Dishwasher air gap 10 has an upper tubular portion 19, a lower tubular portion 20 and a lower tubular portion 24. Upper tubular portion 19 has external treads 52 at its top end which is open to form inlet port 53. The bottom end of upper tubular member 19 has an outlet port 55 that is in communication with inlet port 56 of lower tubular portion 24 that also has its own outlet port 57. Lower tubular member 20 has an inlet port 60 at its bottom end and an outlet port 61 at its top end. Lower tubular portion 20 passes up through the chamber within upper tubular portion 19. An air tube 30 also passes upwardly through the chamber within upper tubular portion 19 and extends above its top end.

Lock nut 22 would be threaded on external threads 52 with most of the external threads extending upwardly above the top surface of kitchen sink 12. Upper locknut fitting 63 has internal threads 64 allowing it to be threaded downwardly over external thread 52 of upper tubular portion 19 and against the top surface of sink 12. Inner cap 66 is press fit down over the upper locknut fitting 63 and a portion of external threads 52 extend above its top edge. Inner cap 66 has two alignment marks 67 on its outer surface whose function will be explained later. One will be painted black and it is the ON mark. The other mark will be painted white and it is the OFF mark.

Spacer 69 has internal threads 70 that allow it to be threaded onto the external threads 52 adjacent the top end of upper tubular portion 19. There will only be four slots 71 in the six divisions that surround the perimeter of spacer 69. They will allow for overflow water from the dishwater 14 to pass outwardly therefrom. Reducing bushing 72 is press fit into the interior of spacer 69 and it has internal threads 73.

A tubular sleeve 75 that is open at both its top and bottom ends contains a bellows 76 having a top wall 77 and a bottom wall 78. An outlet port 79 extends downwardly from bottom wall 78 and it is connected to the top end of air tube 30. A nipple 80 extends upwardly from top wall 77. The bottom end of tubular sleeve 75 is threaded into reducing bushing 72.

A plug adapter ring 82 has internal threads 83 that allow it to be threaded on to the external threads of tubular sleeve 75. It has a recess or relieved portion 83 that form a shoulder 84. A plug 86 has a radially inwardly extending lip 87 that aligns with shoulder 84 to allow outer cap 90 to be pressed downwardly to activate on/off air switch 34. Nipple 80 aligns with recess 91 in plug 86 to compress bellows 76 downwardly. A water vent aperture 93 is provided to allow excess water from the dishwasher 24 to bubble outwardly therefrom. Alignment mark 95 will be painted black and it has to line up with the black ON alignment mark 67 in order for outer cap 90 to be depressed.

Figure 4:
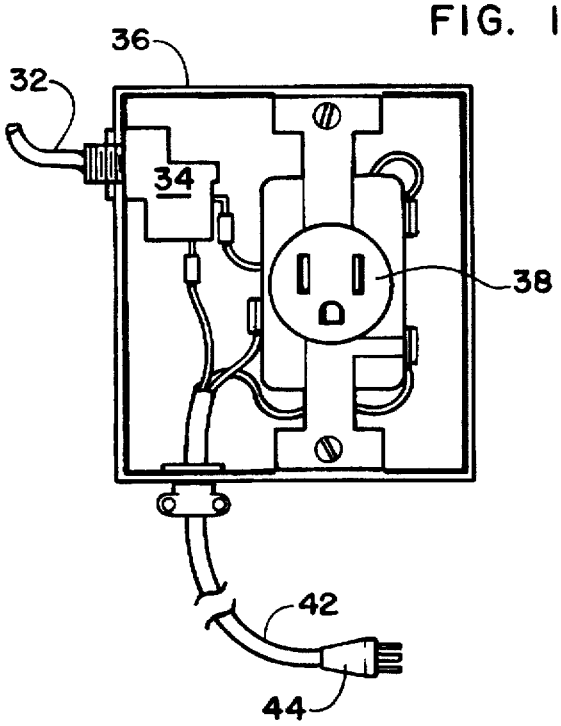
FIG. 4 is a schematic elevation view of the electrical box of the garbage disposal switch assembly.

FIG. 4 is a schematic view of electrical box housing 36. It shows the electrical wires connecting on/off air switch 34 in series with primary electrical outlet socket 38.

What is claimed is:

1. A garbage disposal switch assembly comprising:

a dishwasher air gap body having a vertically oriented upper tubular portion, a first lower tubular portion and a second lower tubular portion;

said upper tubular portion having a top end having an inlet port, a bottom end having an outlet port, and a chamber formed between said top end and said bottom end;

said first lower tubular portion having a top end having an outlet port, a bottom end having an inlet port for connection to a hose from a dishwasher, and said first lower tubular portion extends upwardly through said chamber of said upper tubular portion;

said second lower tubular portion having a top end having an inlet port and a bottom end having an outlet port for connection to a hose from a garbage disposal; said inlet port of said second lower tubular portion being in communication with the outlet port of said upper tubular portion;

an air tube having a top end and a bottom end; said air tube extending upwardly through said upper tubular portion;

an air switch to be mounted in the an interior of a cabinet beneath a kitchen sink;

means for connecting the bottom end of said air tube to said air switch;

an electrical cord having one end electrically connected to said air switch and a second end having a male electrical connector for removably engaging an electrical outlet socket mounted in the interior of the cabinet beneath the kitchen sink;

a primary electrical outlet socket to be mounted in the interior of the cabinet beneath the kitchen sink; means electrically connecting said air switch to said primary electrical outlet socket; means electrically connecting the one end of said electrical cord to said primary electrical outlet socket and said primary electrical outlet socket functions to receive an electrical cord from a garbage disposal mounted under a kitchen sink;

pneumatic actuation means connected to the top end of said air tube for actuating said air switch; and a tubular outer cap having an open bottom end and a closed top end; said outer cap being telescopically removably received over the top end of the upper tubular portion of said dishwasher air gap body.

2. A garbage disposal switch assembly as recited in claim 1 wherein said dishwasher air gap body has an inverted Y-shaped configuration.

3. A garbage disposal switch assembly as recited in claim 1 wherein said air switch and said primary electrical outlet socket are mounted in an electrical box housing.

4. A garbage disposal switch assembly as recited in claim 1 wherein said pneumatic actuation means comprises a bellows having an air chamber; said bellows having a closed top end and a bottom end having an outlet port; said outlet port being connected to the top end of said air tube such that when said bellows is compressed said air switch is actuated.

5. A garbage disposal switch assembly as recited in claim 4 wherein said bellows has a nipple protruding upwardly from the top end.

6. A garbage disposal switch assembly as recited in claim 5 wherein said bellows is mounted in a tubular sleeve having a top end, a bottom end and external threads; a lockout ring having internal threads is threaded on to the top end of said tubular sleeve.

7. A garbage disposal switch assembly as recited in claim 6 further comprising a plug having a bottom surface mounted in an interior of said tubular outer cap adjacent the closed top end; said bottom surface having a recess that aligns with the nipple on the top end of said bellows.

8. A garbage disposal switch assembly as recited in claim 7 further comprising means for selectively allowing said outer cap to be depressed downwardly which results in said nipple being pushed downwardly to compress the bellows causing said air switch to be actuated.

9. A garbage disposal switch assembly as recited in claim 8 further comprising an inner cap telescopically threaded onto the upper tubular portion of said dishwasher airgap body; said inner cap and said outer cap having means for rotationally aligning said outer cap with respect to said inner cap so that said outer cap can be depressed.

* * * * *